US005385500A

United States Patent [19]

Schmidt

[11] Patent Number: 5,385,500

[45] Date of Patent: Jan. 31, 1995

[54] FLASHLIGHT TOY

[76] Inventor: Caitlyn R. Schmidt, 194 Deyo Hill Rd., Johnson City, N.Y. 13790

[21] Appl. No.: 61,893

[22] Filed: May 14, 1993

[51] Int. Cl.[6] ..... A63H 3/00; A63H 33/00; A63H 33/26

[52] U.S. Cl. ..... 446/73; 446/26; 446/71; 446/370; 446/374; 446/485; 362/189

[58] Field of Search ..... 446/26, 71–73, 446/268, 278, 368–370, 373, 374, 485, 486, 365; 362/124, 157, 189, 198, 419; D26/60–62, 65, 93, 94, 98, 103

[56] References Cited

U.S. PATENT DOCUMENTS

| | | | |
|---|---|---|---|
| D. 43,675 | 3/1913 | Nidermajer | D26/98 |
| 559,293 | 4/1896 | Kitchen | 446/368 |
| 599,543 | 2/1898 | Whitaker | D26/103 |
| 928,744 | 7/1909 | Fisher | 362/124 |
| 1,049,345 | 1/1913 | Dolman | 446/368 |
| 1,714,158 | 5/1929 | Colledanchise | 446/368 |
| 1,788,797 | 1/1931 | Lesot | 446/368 |
| 3,019,552 | 2/1962 | Schleich | 446/374 |
| 3,784,196 | 1/1974 | Berlin | 446/368 |
| 3,897,141 | 7/1975 | Schocket | 362/419 |
| 3,960,376 | 6/1976 | Berlin | 446/368 |
| 4,305,560 | 12/1981 | Ban | 362/419 |
| 4,464,861 | 8/1984 | Fogarty et al. | 446/485 |
| 4,495,550 | 1/1985 | Visciano | 362/189 |

FOREIGN PATENT DOCUMENTS

| | | | |
|---|---|---|---|
| 117285 | 7/1918 | United Kingdom | 362/189 |

*Primary Examiner*—Robert A. Hafer
*Assistant Examiner*—Jeffrey D. Carlson
*Attorney, Agent, or Firm*—Salzman & Levy

[57] ABSTRACT

The present invention features a snake toy having an illumination apparatus in its mouth. The body of the snake toy has an inner, flexible, corrugated tube of metal or plastic. The flexible corrugation is easily twisted in order to provide different shapes or configurations for the snake body. In this fashion, the snake can be shaped to stand alone upon a table or to wrap around handlebars of a bicycle or the back of a chair, for example. Likewise, the snake can be easily carried about one's person by wrapping it about the neck, arm, or leg. The twisting and shaping capability also serves as a means by which the illumination from the built-in flashlight can be focused or directed upon an object or a particular spot. By shaping the snake, one can direct the light emanating from the snake's mouth onto the page of a book, for instance. The inner tube of the snake's is covered by soft polyester batting, which is further overlaid with an outer cloth shell.

10 Claims, 5 Drawing Sheets

FLASHLIGHT TOY

FIELD OF THE INVENTION

The present invention pertains to toys that provide illumination, and, more particularly, to a flexible toy that has the capability of bending and twisting in order to provide focused and directed illumination, with the bending and twisting capability additionally providing a means by which the toy can be physically wrapped about a person or a support, or stand alone upon a support.

BACKGROUND OF THE INVENTION

Generally speaking, toys with built-in light devices have often provided fascination. Illuminating toys are quite old in the art, as shown in the illuminated doll figure described in U.S. Pat. No. 928,744 (issued to Fisher on Jul. 20, 1909). Other such devices are shown in U.S. Pat. Nos. 1,300,361 (issued to Edelman on Apr. 15, 1919); 1,773,834 (issued to Wilson on Aug. 26, 1930); 2,647,222 (issued to Nieset on Jul. 28, 1953); 3,784,196 (issued to Berlin on Jan. 8, 1974); and 3,960,376 issued to (Berlin on Jun. 1, 1976).

The present invention features a new toy snake, possessing an illumination that can be directed to and focused on a particular spot. The focusing of the light is useful; it can serve as an illuminator of books, periodicals and magazines. Thus, the user (usually a child) can be encouraged to read, while having a toy accompany her or him in the reading experience.

The focusing of the light in this toy is accomplished by twisting or otherwise manipulating it into various shapes. Shaping the toy provides enjoyment to the user, as well as the means by which a built-in light can be directed to a particular surface or area. Shaping the toy can also provide support. For instance, the shaped toy can be wrapped about the neck, arm or leg, and carried about the person. The toy can also be shaped to stand alone upon a supporting surface, directing light all the while to a given spot.

The toy snake of the invention has built into its mouth a flashlight apparatus consisting of a bulb, focusing shade and battery. The electrical connection between the battery and the illuminating bulb can be accomplished in various ways common to the art. However, the snake offers two unique methods by which light actuation can be achieved in a particular sense befitting the novel twisting and shaping capability of this toy:

a) By twisting the head of the snake, electrical contacts can be brought together to close a circuit. The snake's entire body can be twisted; therefore, this novel twisting function provides a natural means by which the lighting is accomplished.

b) One of the snake's eyes (positioned in adjacent proximity to the lighting apparatus) can disguise the switch used to establish the electrical connections. Depending upon the type of switch used to establish electrical continuity, the eyes can be either pressed or twisted.

DISCUSSION OF RELATED ART

An illuminated snake toy is shown in U.S. Pat. Nos. 3,784,196 (issued to Berlin on Jan. 8, 1974); and 3,960,376 (issued to Berlin on Jun. 1, 1976). The toy snake of these inventions presents a rigid snake, with the novelty being directed toward the balancing of the snake in order to accomplish the illumination. The toy snake is not meant to serve as a means by which illumination can be provided for reading books. This balancing toy obviously cannot stand alone and is not self-supporting, as is the case with the present invention.

SUMMARY OF THE INVENTION

In accordance with the present invention, there is provided a snake toy having an illumination apparatus in its mouth. The body of the snake toy comprises an inner, flexible, corrugated tube of metal or plastic. The flexible corrugation is easily twisted to provide different shapes or configurations for the snake body. In this fashion, the snake can be shaped to stand alone upon a table or to wrap around handlebars of a bicycle or around the back of a chair. Likewise, the snake can be easily carried about one's person by wrapping it about the neck, arm or leg. The twisting and shaping capability also serves as a means by which the illumination from the built-in flashlight can be focused or directed upon an object or a particular spot. By shaping the snake, one can direct the light emanating from the snake's mouth onto the page of a book, for instance. The inner tube of the body of the snake is covered by soft polyester batting, which is further overlaid with an outer cloth shell. The flashlight apparatus disposed in the mouth of the snake comprises standard flashlight elements, consisting of a light bulb, a silvered focusing shade and AA flashlight batteries. The electrical circuit between the batteries and the bulb is accomplished by means of a switch (supported in the snake's head) comprising electrical contacts. Twisting the snake serves to force the contacts to close and establish the electrical circuit. In an alternate embodiment, one of the eyes of the snake can disguise a switch that can be used to complete the circuit.

It is an object of the present invention to provide a toy that can be shaped to provide the dual function of illumination and support.

It is another object of this invention to provide a flexible illumination toy having a light that can be focused and directed to a particular spot in order to provide, for example, a means by which to read.

It is a further object of the invention to provide a twistable toy having a shape that can be configured to provide a means by which it can be carried about one's person.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same designation throughout the FIGURES.

DESCRIPTION OF THE PREFERRED EMBODIMENT

Generally speaking, the invention features a unique snake toy with a flashlight disposed in its mouth. The toy is flexible and, therefore, easily shaped so that it can be carried about one's person or stand alone as an object. In so shaping or configuring the toy, one can also focus the light emanating from the toy's mouth so that it can be directed at a given spot, such as the page of a book.

Figure 1:
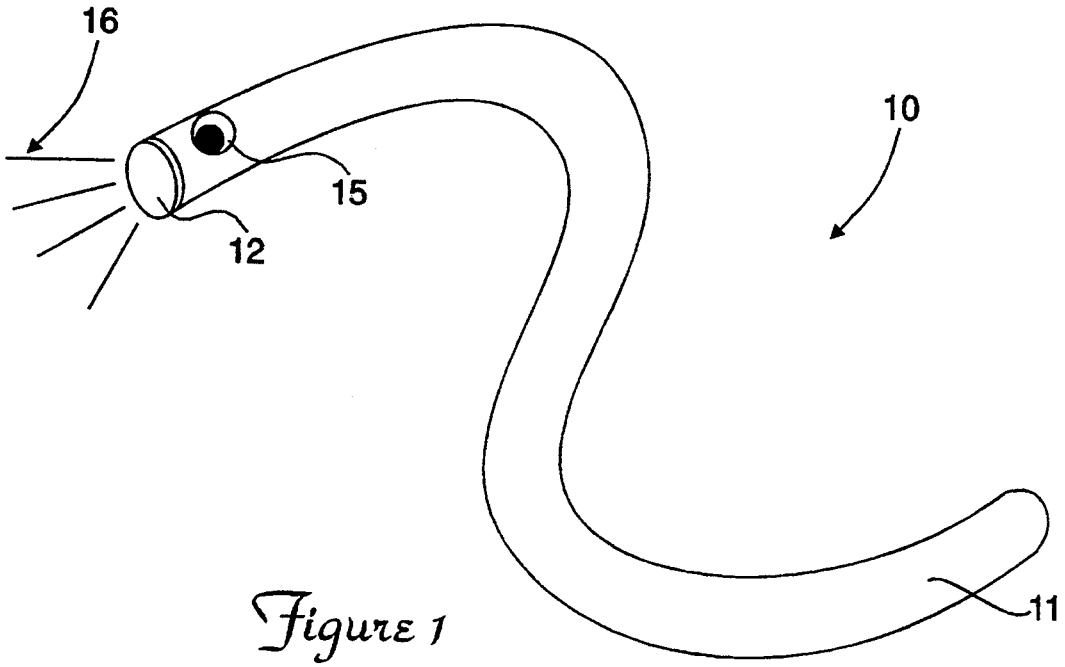
FIG. 1 is a perspective view of the snake toy of the invention.

Now referring to FIG. 1, a perspective view of the flexible toy snake 10 of this invention is shown. The toy snake 10 comprises a body portion 11 having an opening 12 that simulates the mouth of the snake and a decorative eye 15. A flashlight apparatus 14, shown in FIG. 2, is disposed inside the snake 10, shining light (depicted by rays 16) from the opening 12.

Figure 3:
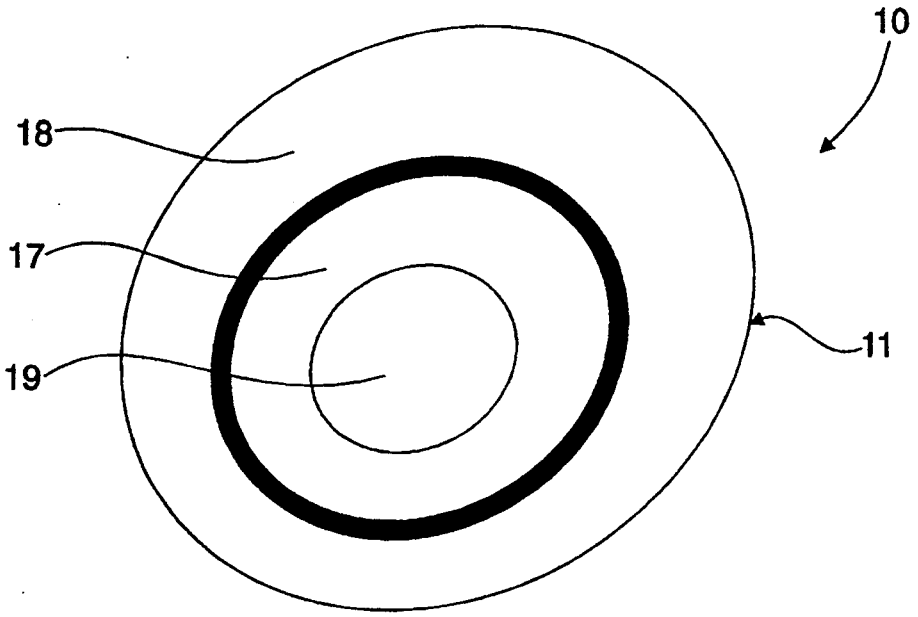
FIG. 3 is a sectional view, taken along axis A—A, of the snake toy depicted in FIG. 2.
Figure 2:
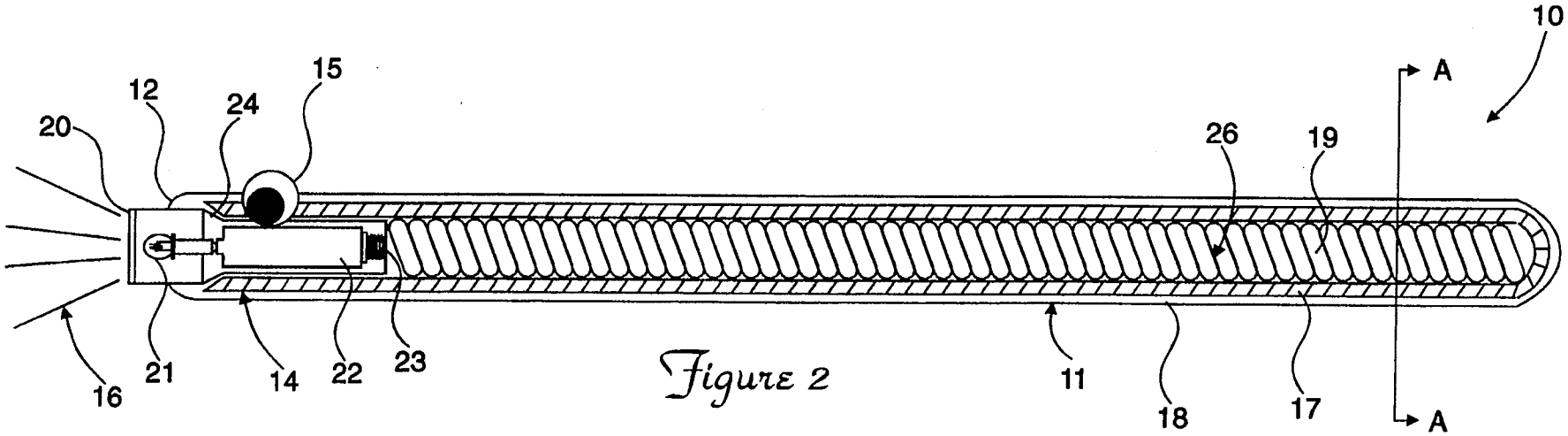
FIG. 2 is a sectional view, taken along its longitudinal axis, of the snake toy shown in FIG. 1.
Figure 9:
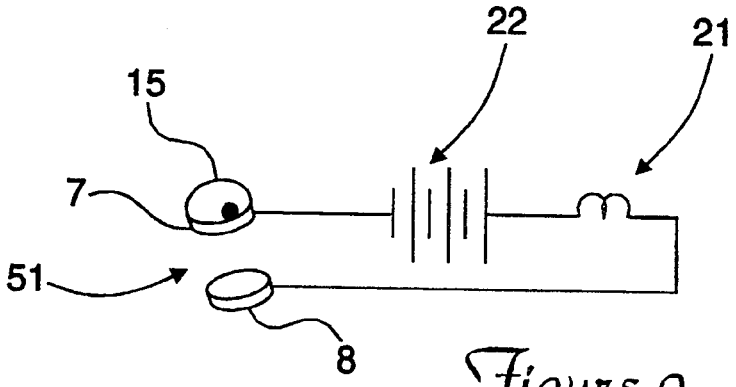
FIG. 9 depicts a schematic of a switching circuit for the snake toy illustrated in FIG. 1.
Figure 10:
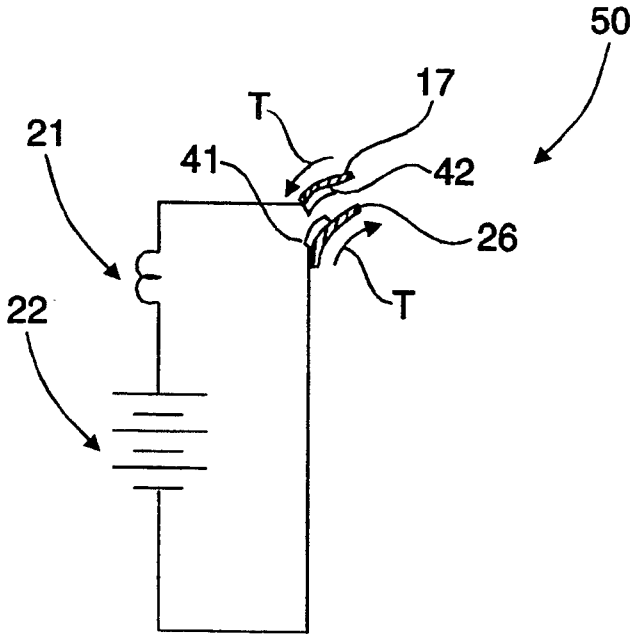
FIG. 10 shows a schematic of an alternate embodiment of the switching circuit depicted in FIG. 9.

Referring to FIGS. 2 and 3, cross-sectional views are shown of the snake 10. The flashlight apparatus 14 is disposed in the mouth portion of the snake toy 10, in proximity to the eye 15. The flashlight apparatus is housed within a casing 23 that can be pulled out of the mouth opening 12, in order for the replacement of the batteries 22 that power the flashlight apparatus 14. The flashlight apparatus 14 comprises a lens 20, through which light 16 from the flashlight apparatus 14 emanates, a bulb 21 and a plurality of AA batteries 22. The bulb 21 is generally disposed within a flared reflector 24 to intensify the light leaving the lens 20. The flashlight apparatus 14 is actuated by means of a switch or movable contacts 41 and 42, which complete an electrical circuit 50 shown in FIG. 10. When the snake is twisted as shown by arrows T, the electrical contacts 41 and 42, respectively attached to batting 17 and tube 26 of the flashlight apparatus close, thus actuating the light. In another embodiment, as shown in the circuit depicted in FIG. 9, the eye 15 can disguise a hidden switch. The eye switch 51, formed by respective, pressure-sensitive contacts 7 and 8, can be pressed or turned in order to close the electrical circuit.

The snake body 11 comprises an inner core member 19 that is formed from a corrugated tube 26 of flexible metal or plastic. The corrugated tube 26 is easily turned, twisted or shaped, and takes a slight set to maintain and to configure the snake toy 10 in various shapes, as described hereinafter with respect to FIGS. 4 through 8. Over the tube 26 is layered a polyester batting 17 to provide softness. Disposed over the batting 17 is a layer of decorative cloth or "skin"18. The snake toy 10 can be twisted or shaped due to of its inner flexible core member 19. The snake body 11 has no memory thus maintaining its shape when bent or twisted into different configurations and then released.

Figure 4:
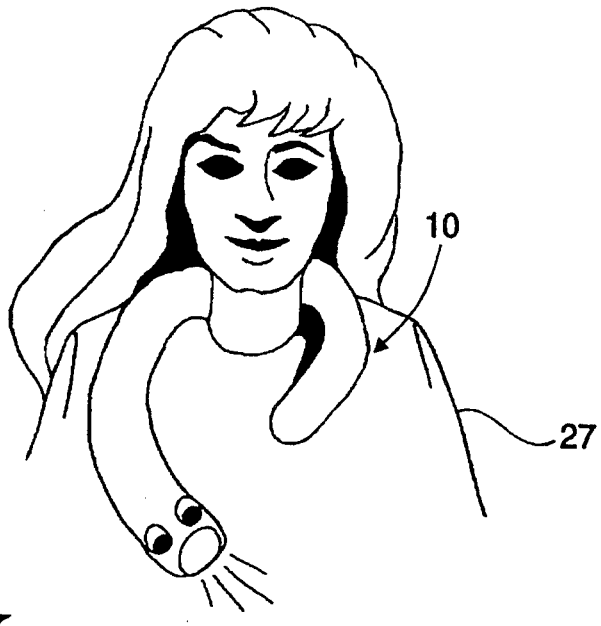
FIGS. 4 through 8 illustrate in situ views of the snake toy shown in FIG. 1, in differing shapes and configurations as desired for its various end uses
Figure 5:
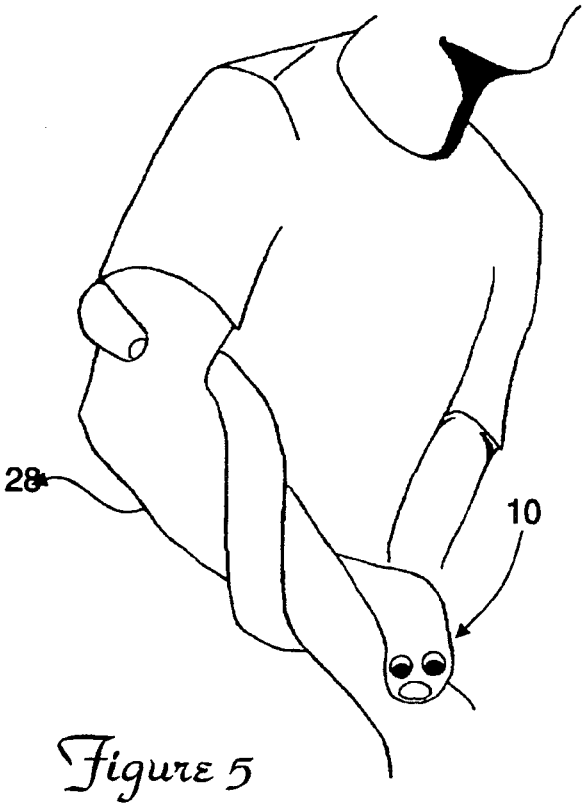
Figure 6:
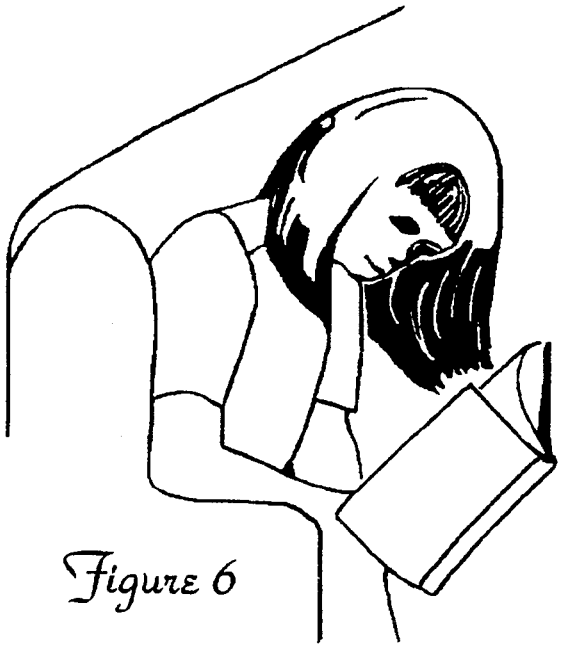
Figure 7:
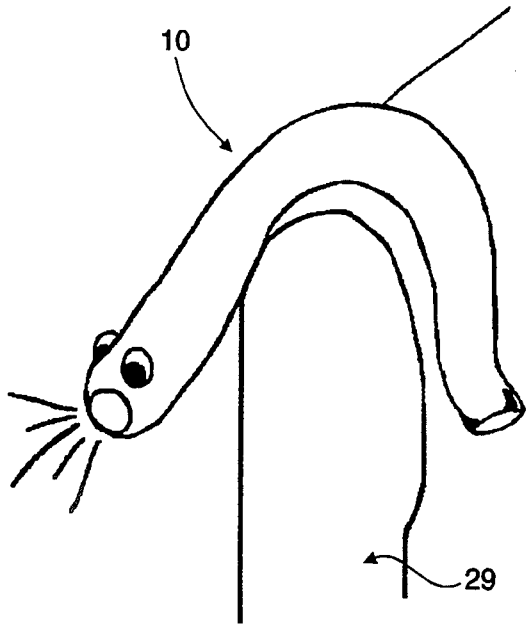
Figure 8:
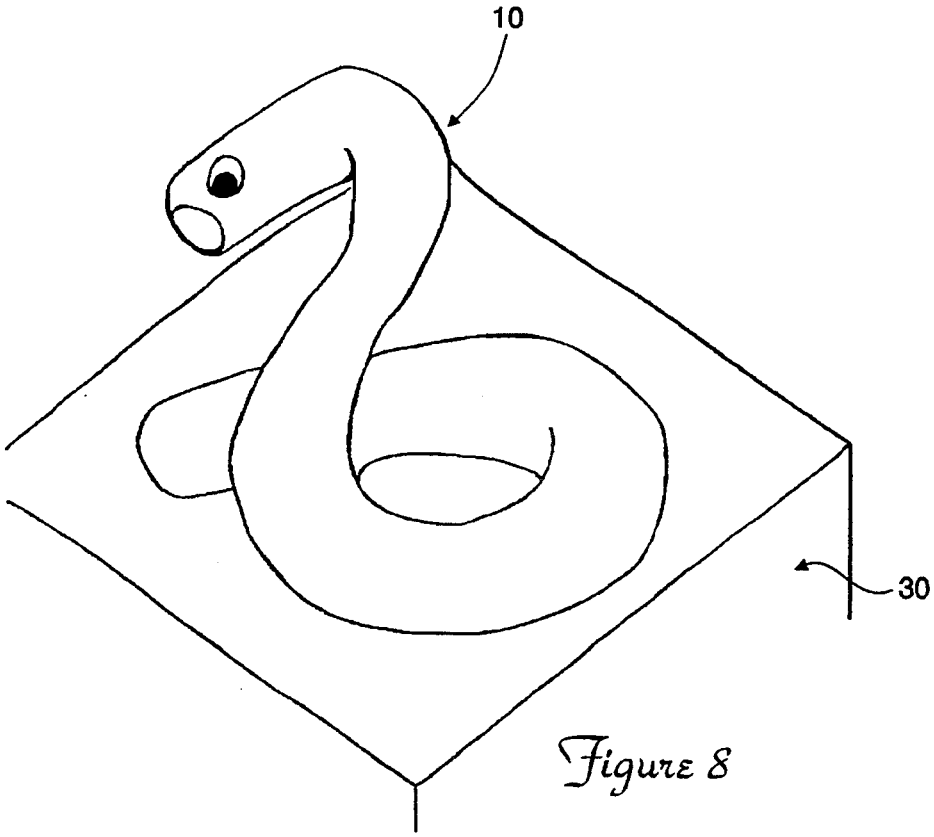

Referring to FIGS. 4 through 8, the snake toy 10 has been configured into various shapes as befits the various purposes of the invention. FIG. 4 illustrates the snake 10 being worn about a person's neck 27. In this position, the snake toy 10 can act as a reading light or lamp, as illustrated in FIG. 6. In FIG. 5, the snake toy 10 has been twisted so that it wraps about the arm 28. In this embodiment, the snake 10 can be easily carried about the person as a decorative flashlight. In FIG. 7, the snake toy 10 is shown configured on the back 29 of a chair or sofa. In this position, it can serve as an area light to illuminate a table or other portion of the room. In FIG. 8, the snake 10 is configured as a decorative sculpture or lamp disposed upon pedestal 30.

There are many uses and purposes to which the snake toy of this invention can be put. All that is necessary is to have a little imagination. The flexible body 11 of the snake 10 allows for shaping the snake toy so that it can rest on different surfaces, projecting its light in different directions.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A flexible toy, comprising a flexible body portion having a flexible, inner core member comprising a flexible corrugated tube that can be twisted or shaped, said flexible body portion, having no memory, and maintaining its shape when it is wrapped, twisted and configured to conform said body portion to surfaces in which it is brought into contact and then released, said corrugated tube being overlaid with decorative skin, said flexible toy having means defining an opening at one end, with a flashlight apparatus being disposed within said opening and light emanating from the flashlight apparatus being caused to project from said opening, said shaping of said flexible body portion having the dual purpose of both configuring said flexible toy and directing the light emanating from said opening upon a particular spot or object.

2. The flexible toy in accordance with claim 1, wherein said body portion is configured to resemble a snake.

3. The flexible toy in accordance with claim 1, wherein said flexible corrugated tube is overlaid with soft batting and said decorative skin.

4. A flexible toy, comprising a flexible body portion including a hollow, tube that has no memory, and can maintain its shape when it is wrapped, twisted and configured to conform said body portion to surfaces in which it is brought into contact and then released said hollow tube being overlaid with a skin covering, said flexible toy having means defining an opening at one end, with a flashlight apparatus being disposed within said opening and light emanating from the flashlight apparatus being caused to project from said opening, said twisting of said flexible body portion having the dual purpose of both configuring said flexible toy and actuating said flashlight apparatus.

5. The flexible toy in accordance with claim 4, wherein said body portion is configured to resemble a snake.

6. The flexible toy in accordance with claim 4, wherein can be twisted or shaped so that flexible toy can be configured.

7. The flexible toy in accordance with claim 6, wherein said flexible corrugated tube is overlaid with soft batting and said skin covering.

8. A flexible, elongated toy resembling a snake, having a body portion that has no memory, and maintains its shape when it is wrapped, twisted and configured to conform to surfaces in which it is brought into contact and then released, said flexible, elongated toy having means defining an opening at one end that defines the mouth of said snake, said toy comprising:

a flashlight apparatus disposed in said opening of said body portion for providing light that is directed from said mouth;

an inner, flexible corrugated tube disposed within said body portion, said corrugated tube being twistable, wrappable and configurable so as to maintain the body portion in different desired shapes, said body portion further comprising and supporting a decorative eye, said eye disguising a switch for actuating said flashlight apparatus;

a batting that overlays said corrugated tube for the purpose of providing softness to said elongated toy; and a covering disposed over said batting.

9. The flexible, elongated toy in accordance with claim 8, wherein said batting comprises polyester material.

10. The flexible, elongated toy in accordance with claim 8, being decoratively configured as a lamp.

* * * * *